US005607825A

United States Patent [19]

Carlson

[11] Patent Number: 5,607,825

[45] Date of Patent: Mar. 4, 1997

[54] GELATIN COMPATIBLE ANTISTATIC COATING COMPOSITION

[75] Inventor: Robert L. Carlson, St. Paul, Minn.

[73] Assignee: Minnesota Mining and Manufacturing, St. Paul, Minn.

[21] Appl. No.: 486,443

[22] Filed: Jun. 8, 1995

[51] Int. Cl.[6] ..... G03C 1/89

[52] U.S. Cl. ..... 430/529; 430/527; 430/530; 430/642; 428/477.7

[58] Field of Search ..... 430/527, 529, 430/530, 642; 428/477.7

[56] References Cited

U.S. PATENT DOCUMENTS 5,427,835 6/1995 Morrison et al. ..... 430/527

5,439,789 8/1995 Boston et al. ..... 430/530

OTHER PUBLICATIONS

Translation of Japanese Patent Application (Kokai) No. 5–100358 laid open on Apr. 23, 1993.

*Primary Examiner*—Richard L. Schilling
*Attorney, Agent, or Firm*—Gary L. Griswold; Walter N. Kirn; Gregory A. Evearitt

[57] ABSTRACT

A photographic film construction at least one side of which is coated with an antistatic layer comprising a binder of gelatin grafted to a poly(ethylenic) polymer having acid functional groups on the polymer and a dispersion of vanadium oxide particles in the grafted gelatin binder.

19 Claims, No Drawings

GELATIN COMPATIBLE ANTISTATIC COATING COMPOSITION

FIELD OF THE INVENTION

The present invention relates to photographic film constructions which are provided with antistatic layers, and to light-sensitive photographic elements comprising said film layers.

BACKGROUND OF THE ART

The use of polymeric film bases for carrying photographic layers is well known. In particular, photographic elements which require accurate physical characteristics use polyester film bases, such as poly(ethylene terephthalate) or poly(ethylene naphthalate) film bases. In fact, polyester film bases, when compared with commonly used cellulose ester film bases, are dimensionally more stable and more resistant to mechanical stresses under most conditions of use.

The formation of static electric charges on the film base is a serious problem in the production of photographic elements. While coating the light-sensitive photographic emulsion, electric charges which may accumulate on the base can discharge, producing light which may be recorded as an image on the light-sensitive layer. Other drawbacks which result from the accumulation of electric charges on polymeric film bases include the adherence of dust and dirt and coating defects.

Additionally, photographic elements comprising light-sensitive layers coated onto polymeric film bases, when used in rolls or reels which are mechanically wound and unwound or in sheets which are conveyed at high speed, tend to accumulate static charges and record the light generated by the static discharges.

The static-related damages may occur not only during the manufacturing process but also in the subsequent handling of the film prior to processing during which the photographic image is developed and the excess silver halide is removed.

Several techniques have been suggested to protect photographic elements from the adverse effects of static charges.

Matting agents, hygroscopic materials or electroconductive polymers have been proposed to prevent static buildup, each acting with a different mechanism. However, matting agents cause haze, dust and dirt problems, hygroscopic materials cause sheets or films to stick together or with other surfaces, and electroconductive polymers frequently are not transparent when coated with conventional binders.

Layers containing vanadium oxide particles have proved to be useful classes of antistatic protection layers in the field of imaging technologies. U.S. Pat. No. 4,203,769 provided an initial disclosure of vanadium oxide coatings used on photographic substrates to provide antistatic protection. Many subsequent patents provide teachings of improved vanadium oxide formulations and binder compositions which improve the performance and stability of the vanadium oxide antistatic layers on imaging media. Amongst these patents are U.S. Pat. Nos. 5,203,884; 5,322,761; 5,372,985; and 5,407,603 which disclose processes for manufacturing improved vanadium oxide colloidal dispersions, flexographic printing plates with vanadium oxide antistatic layers, and thermal transfer elements with vanadium oxide antistatic layers. U.S. patent applications Ser. No. 07/893,279 bearing attorneys docket no. 48349USA1A and 08/277,097 bearing attorney's docket no. 49675USA6B disclose improved binder systems for vanadium oxide antistatic layers.

As increased speed in manufacturing, conveying and processing a film is important in the photographic industry, improvement in antistaticity of photographic layers is strongly desired. It is also desirable that the antistatic element is readily applied either as a subbing layer during the base making operation or as a part of the layer construction making up the photographic element. The present invention satisfies these requirements.

SUMMARY OF THE INVENTION

In one embodiment, the invention is directed to a polymeric film base at least one side of which is coated with an antistatic layer comprising a binder of gelatin grafted to a poly(ethylenic) polymer having acid groups on the polymer and a dispersion of vanadium oxide particles in the grafted gelatin binder.

In a specific embodiment, the invention is directed to a photographic element comprising a polymeric film base, a silver halide emulsion layer on said film base, and an antistatic layer having a binder which comprises the product of gelatin and a polymer bearing pendant acid groups, such as gelatin grafted to polystyrenesulfonate, and dispersed in the binder is colloidal vanadium oxide particles. The modified gelatin is more compatible with the vanadium oxide dispersion than unmodified gelatin, yet maintains a good level of chemical and physical properties generally associated with gelatin.

DETAILED DESCRIPTION OF THE INVENTION

The present invention comprises an antistatic film construction particularly useful for imaging media, especially silver halide photographic media. The film base comprises a polymeric substrate such as a polyester, and especially such as polyethyleneterephthalate. Other useful polymeric substrates include cellulose acetates, polyolefins, polycarbonates and the like. The film base has an antistatic layer adhered to one or both major surfaces of the base. A primer layer or subbing layers may be used between the base itself and the antistatic layer as may one or more layer comprising gelatin. Priming and subbing layers are, in fact, generally considered to be part of the base itself unless specifically excluded in the description (e.g., unsubbed polyester). Primer and subbing compositions are well known in the art and polymers of vinylidene chloride often comprise the primer composition of choice for photographic elements.

The components of the antistatic layer of the present invention are a graft-copolymer of an ethylenic derived polymer having acid functional groups and gelatin together with particles of vanadium oxide. The addition of further amounts of photographic gelatin can be made after the two principal components above are mixed to form a homogeneous mixture. The antistatic layer of the present invention may also contain other addenda such as matting agents, surfactants, gelatin cross linking agents, dyes auxiliary chemicals and silver halide emulsions.

The antistatic coating is usually provided in coating thickness based on the dry thickness of from 0.1 micron to 10 microns. Lower coating weights usually provide less adequate antistatic protection and higher coating weights usually give less transparent layers. The coating may be performed by conventional coating techniques, such as, for example, air knife coating, gravure coating, extrusion coating, curtain coating, and doctor roller coating. A preferred method of coating when the antistatic layer is coated as one of two or more gelatin consisting layers coated wet on wet and together is by the slot coating techniques. This coating, made at a temperature sufficiently above the set point of the coating mixtures can be chilled to set the layer and conveniently dried by air impingement.

The imaging elements useful in the present invention may be any of the well-known elements for imaging in the field of graphic arts, printing, medical and information systems. Silver halide, photopolymers, diazo, vesicular image-forming systems may be used, silver halide being preferred.

Typical imaging element constructions of the present invention comprise:

1. The film base with an antistatic layer on one surface and the photosensitive layer or layers, preferably photographic silver halide emulsion layer or layers, on the other surface of the film base. In this construction an auxiliary layer may or may not be present either over or under the antistatic layer. Examples of auxiliary layers include backing gelatin protective layers and backing gelatin antihalation layers. The auxiliary is frequently of such a thickness as to compensate for curl promoted by the forces of the imaging layer on the opposite side of the substrate.
2. The film base with a prime and subbing layer on one surface and at least one photosensitive layer adhered to the same surface as the antistatic layer. The antistatic layer, may either be over or under the photosensitive layer.
3. The film base with a prime and subbing layer on both surfaces of the polymeric base and at least one photosensitive layer on one or both sides of the film base. The antistatic layer may either be over or under the photosensitive layer.
4. The antistatic layer may comprise the subbing layer referred to above.

The gelatin having an ethylenically polymerized polymer with acid groups pendant thereon may be any ethylenic addition polymer (or copolymer) in which moieties within the polymer provide pendant acid groups. The acid groups may be, for example, sulfonic, sulfinic, or carboxylic. Phosphonic or phosphinic acid groups could be used, but these tend to be less photometrically (particularly less photographically) inert. The acid groups are most conveniently placed within the polymer by selecting monomeric reagents which have ethylenic unsaturation and a pendant acid group(s) which will not be removed during the polymerization of the monomer.

There must be a reasonable number of acid groups present to have a significant effect, although the presence of any acid groups on the polymer grafted to the gelatin initiate an improvement. For example, acid numbers (the molecular weight of the polymer divided by the number of pendant acid groups per polymer molecule) should be below 10,000, preferably below 5,000, and more preferably below 2,500. Polystyrene sulfonate is the monomer of choice for adding the acid groups (for a sulfonate acid group) and other well known acid providing monomers are acceptable. The use of maleic anhydride to provide carboxylic groups, and acidic counterparts of the styrene sulfonate could be used to provide the other acid groups. The polymer may then be grafted onto the gelatin by conventional means as done commercially in the case of the gelatin-polystyrene sulfonate polymers used in the present examples. Other comonomers which do not contribute to the acidic level of the polymer may also be included within the polymer grafted to the gelatin.

Examples of silver halide photographic elements applicable to this invention include black-and-white and color photographic elements.

The silver halide employed in this invention may be any of silver chloride, silver bromide, silver iodide, silver chlorobromide, silver chloroiodide, silver bromoiodide, silver chloroiodobromide, and the like.

The silver halide grains in the photographic emulsion may be regular grains having a regular crystal structure such as cube, octahedron, and tetradecahedron, or the spherical or irregular crystal structure, or those having crystal defects such as twin planes, or those having a tabular form, or combinations thereof.

As the binder or protective colloid for use in the photographic element, gelatin is advantageously used, but other hydrophilic colloids may be used such as gelatin substitutes, collodion, gum arabic, cellulose ester derivatives such as alkyl esters of carboxylated cellulose, hydroxy ethyl cellulose, carboxy methyl cellulose, synthetic resins, such as the amphoteric copolymers described in U.S. Pat. No. 2,949,442, polyvinyl alcohol, and others well known in the art.

The photographic elements utilizing the antistatic layer of this invention have radiation-sensitive silver halide emulsion layers, i.e. silver halide emulsions sensitive to the visible, ultraviolet or infrared light. The silver halide emulsions may be optically sensitized by any of the spectral sensitizers commonly used to produce the desired sensitometric characteristics.

Methods for making such elements, means for sensitizing them to radiation, use of additives such as chemical sensitizers, antifoggants and stabilizers, desensitizers, brightening agents, couplers, hardening agents, coating aids, plasticizers, lubricants, matting agents, high-boiling organic solvents, development accelerating compounds, antistatic agents, antistain agents, and the like are described for example, in Research Disclosure Vol. 176, No. 17643, December 1979, Sections I to XIV.

The following examples, which further illustrate the invention, report some experimental data obtained from processes and measurements which are of normal use in the art. Charge decay was measured at 20° C. and 10% RH using an ETS static decay meter model 406C: samples of each film were put in a Faraday cage and a positive charging voltage of 5 KV was applied to each sample; after that, the time needed to dissipate the applied charge to 0% of the initial charging voltage was measured.

Colloidal dispersions of vanadium oxide can be prepared as described in U.S. Pat. No. 4,203,769 and in U.S. Pat. No. 5,407,603. Both patents are incorporated herein by reference with respect to the preparation of such dispersions.

The preferred vanadium oxide sols, i.e., colloidal dispersions, useful in the present invention are prepared by hydrolyzing vanadium oxoalkoxides with a molar excess of deionized water. In preferred embodiments, the vanadium oxoalkoxides are prepared in situ from a vanadium oxide precursor species and an alcohol. The vanadium oxide precursor species is preferably a vanadium oxyhalide or vanadium oxyacetate. If the vanadium oxoalkoxide is prepared in situ, the vanadium oxoalkoxide may also include other ligands such as acetate groups.

Preferably, the vanadium oxoalkoxide is a trialkoxide of the formula $VO(OR)_3$, wherein each R is independently an aliphatic, aryl, heterocyclic, or arylalkyl group.

The hydrolysis process results in condensation of the vanadium oxoalkoxides to vanadium oxide colloidal dispersions. It can be carried out in water within a temperature range in which the solvent, which preferably is deionized water or a mixture of deionized water and a water-miscible organic solvent, is in a liquid form, e.g., within a range of about 0°–100° C. The process is preferably carried out within a temperature range of about 20°–30° C. The hydrolysis preferably involves the addition of a vanadium oxoalkoxide to deionized water.

In preferred embodiments, the deionized water or mixture of deionized water and water-miscible organic solvents contains an effective amount of a hydroperoxide, such as $H_2O_2$. Preferably, the reaction mixture is aged from 40° C.–90° C. for from 8 hours to 14 days. Optionally, the reaction mixture also can be modified by the addition of co-reagents, addition of metal dopants, heat treatments, and removal of alcohol byproducts. By such modifications the vanadium oxide colloidal dispersion properties can be varied.

The vanadium oxoalkoxides can also be prepared in situ from a vanadium oxide precursor species in aqueous medium and an alcohol. For example, the vanadium oxoalkoxides can be generated in the reaction flask in which the hydrolysis, and subsequent condensation reactions occur. That is, the vanadium oxoalkoxides can be generated by combining a vanadium oxide precursor species, such as, for example, a vanadium oxyhalide ($VOX_3$), preferably $VOCl_3$, or vanadium oxyacetate ($VO_2OAc$), with a appropriate alcohol, such as i-BuOH, i-PrOH, n-PrOH, n-BuOH, t-BuOH, and the like, wherein Bu=butyl and Pr=propyl. It is understood that if vanadium oxoalkoxides are generated in situ, they may be mixed alkoxides. For example, the product of the in Situ reaction of vanadium oxyacetate with an alcohol is a mixed alkoxide/acetate. Thus, herein the term "vanadium oxoalkoxide" is used to refer to species that have at least one alkoxide (—OR) group, particularly if prepared in situ. Preferably the vanadium oxoalkoxides are trialkoxides with three alkoxide groups.

The in situ preparations of the vanadium oxoalkoxides are preferably carried out under an inert atmosphere, such as nitrogen or argon. The vanadium oxide precursor species is typically added to an appropriate alcohol at room temperature. When the reaction is exothermic, it is added at a controlled rate such that the reaction mixture temperature does not greatly exceed room temperature. The temperature of the reaction mixture can be further controlled by placing the reaction flask in a constant temperature bath, such as an ice water bath. The reaction of the vanadium oxide species and the alcohol can be done in the presence of an oxirane, such as propylene oxide, ethylene oxide, or epichlorohydfin, and the like. The oxirane is effective at removing byproducts of the reaction of the vanadium oxide species, particularly vanadium dioxide acetate and vanadium oxyhalides, with alcohols. If desired, volatile starting materials and reaction products can be removed through distillation or evaporative techniques, such as rotary evaporation. The resultant vanadium oxoalkoxide product, whether in the form of a solution or a solid residue after the use of distillation or evaporative techniques, can be added directly to water to produce the vanadium oxide colloidal dispersions.

A preferred method of making the colloidal dispersion involves adding a vanadium oxoalkoxide to a molar excess of water, preferably with stirring until a homogeneous colloidal dispersion forms. By a "molar excess" of water, it is meant that a sufficient amount of water is present relative to the amount of vanadium oxoalkoxide such that there is greater than a 1:1 molar ratio of water to vanadium-bound alkoxide. Preferably, a sufficient amount of water is used such that the final colloidal dispersion formed contains less than about 4.5 wt percent and at least a minimum effective amount of vanadium. This typically requires a molar ratio of water to vanadium alkoxide of at least about 45:1, and preferably at least about 150:1.

In preparing the preferred vanadium oxide colloidal dispersion of the present invention, a sufficient amount of water is used such that the colloidal dispersion formed contains about 0.05 weight percent to about 3.5 weight percent vanadium. Most preferably, a sufficient amount of water is used so that the colloidal dispersion formed upon addition of the vanadium-containing species contains about 0.6 weight percent to about 1.7 weight percent vanadium. Preferably, the water used in methods of the present invention is deionized water.

Miscible organic solvents include, but are not limited to, alcohols, low molecular weight ketones, dioxane, and solvents with a high dielectric constant, such as acetonitrile, dimethylformamide, dimethylsulfoxide, and the like. Preferably, the organic solvent is acetone or an alcohol such as i-BuOH, i-PrOH, n-PrOH, n-BuOH, t-BuOH, and the like.

Preferably, the reaction mixture also contains an effective amount of hydroperoxide, such as $H_2O_2$ or t-butyl hydrogen peroxide. An "effective amount" of a hydroperoxide is an amount that positively or favorably effects the formation of a colloidal dispersion capable of producing an antistatic coating. The presence of the hydroperoxide appears to improve the dispersive characteristics of the colloidal dispersion and facilitate production of an antistatic coating with highly desirable properties. That is, when an effective amount of hydroperoxide is used, the resultant colloidal dispersions are less turbid, and more well dispersed. Preferably, the hydroperoxide is present in an amount such that the molar ratio of vanadium oxoalkoxide to hydroperoxide is within a range of about 1:1 to 4: 1.

Other methods known for the preparation of vanadium oxide colloidal dispersions, which are less preferred, include inorganic methods such as ion exchange acidification of $NaVO_3$, thermohydrolysis of $OCl_3$, and reaction of $V_2O_5$ with $H_2O_2$. To provide coatings with effective antistatic properties from dispersions prepared with inorganic precursors typically requires substantial surface concentrations of vanadium, which generally results in the loss of desirable properties such as transparency, adhesion, and uniformity.

Vanadium Oxide Sol Preparation

A series of vanadium oxide sols was prepared as described below. The surface concentration of vanadium reported below was calculated from formulation data assuming the density of each vanadium oxide coating solution to be that of water (1 g/mL), and the wet coating thickness obtained with a No. 3 Mayer bar to be 6.9 micrometers and the wet coating thicknesses obtained with other Mayer bars to be similarly proportional to the Mayer bar number. An Inductively Couple Plasma (ICP) Spectroscopic analysis of vanadium surface concentration of several subsequently coated polyester film samples showed that the actual vanadium surface concentration was consistently 40% of that calculated from the amount coated from a particular concentration of coating dispersion.

Preparation "A"

A vanadium oxide sol was prepared by adding VO $(O\text{-}iBu)_3$ (15.8 g, 0.055 mol, product of Akzo Chemicals, Inc., Chicago, Ill.) to a rapidly stirred solution of $H_2O_2$ (1.56 g 30% aqueous solution, 0.0138 mol, Mallinckrodt, Paris, Ky.) in deionized water (252.8 g), to provide a solution with vanadium concentration=0.22 moles/kg (2.0% $V_2O_5$). Upon addition of VO $(O\text{-}iBu)_3$, the mixture became dark brown and gelled within five minutes. With continued stirring, the dark brown gel broke up, giving an inhomogeneous viscous dark brown solution which was homogeneous in about 45 minutes. The sample was allowed to stir for 1.5 hours at room temperature and was diluted with an equal weight portion of deionized water (DI $H_2O$), then transferred to a polyethylene container and aged in a constant temperature bath at 60° C. for 4 days to give a dark brown thixotropic gel. The concentration of V(+4) in the gel was determined by titration with potassium permanganate to be 0.072 moles/kg. This corresponds to a mole fraction of V(+4) [i.e., V(+4)/total vanadium] of 0.33.

Preparation "B"

These are other ways to prepare $V_2O_5$.

A $V_2O_5$ dispersion was prepared according to the procedure described in U.S. Pat. No. 4,203,769. $V_2O_5$ (15.6 g., 0.086 mol, Aldrich Chemical Co., Milwaukee, Wis.) was heated in a covered platinum crucible for 10 minutes at 1100° C. and then poured into 487 g of rapidly stirring DI $H_2O$. The resulting liquid plus gelatinous black precipitate was warmed to 40°–45° C. for 10 minutes and allowed to stir for 1 hour at room temperature to give a soft, thixotropic black gel which was diluted with 1041 g DI $H_2O$ to give a 1.0% $V_2O_5$ dispersion. The viscous colloidal dispersion was filtered to remove undispersed $V_2O_5$.

Preparation "C"

These were done here for comparison examples.

A $V_2O_5$ dispersion was prepared by an ion exchange process. Sodium metavanadate (6.0 g, 0.049 mol, Alfa Products, Ward Hill, Mass.) was dissolved by warming in 144 g deionized $H_2O$ and the resulting solution was filtered to remove insoluble material. The filtered solution was pumped through a 15 mm×600 mm chromatography column containing 600 mL of Amberlite IR 120 Plus (H+) and diluted with DI $H_2O$ to give a light orange solution containing 2.0% $V_2O_5$. The solution became a soft opaque brick red gel upon standing at room temperature for 24 hours. The dispersion had aged for 14 months at room temperature before use in coatings.

EXAMPLE 1

Three percent solutions of gelatin and graft-copolymers of polystyrene sulfonate and photographic gelatin were prepared by soaking the material in chilled deionized water for one hour, heating to 50° C. and stirring until solution was complete. They were then cooled to 40° C., at which temperature they were held. A 0.3% dispersion of vanadium oxide in water was added dropwise with stirring until a total of 50 grams of the dispersion had been added to 200 grams of the respective solution. The resultant mixtures were then rated as INCOMPATIBLE (no evidence of forming a homogeneous mixture), PARTIALLY COMPATIBLE (some evidence of forming a homogeneous mixture but incomplete) or COMPATIBLE (a homogeneous mixture is formed with no evidence of incompatibility). The formation of a homogeneous mixture is a necessary requirement for coating purposes. The TABLE 1 below compares the mixtures.

TABLE 1

Compatibility of $V_2O_5$ Dispersion with Gelatin and Gelatin:PSS[1] Solutions

| Sample ID | Ratio Gel:PSS | $V_2O_5$ Compatibility |
|---|---|---|
| Croda Lime Bone | 100:0 | Incompatible |
| K+K Pigskin | 100:0 | Incompatible |
| Croda I | 90:10 | Incompatible |
| Croda II | 80:20 | Partially Compatible |
| Croda III | 70:30 | Compatible |
| Croda IV | 50:50 | Compatible |

[1]Gel:PSS refers to ratio of gelatin to grafted polystyrene sulfonate.
[2]Croda and K&K refer to commercial organizations supplying materials.

The above data illustrates the necessary degree of gelatin modification by polystyrene sulfonate (PSS) for compatibility with the vanadium pentoxide dispersion. It is believed that at least 15% by weight of the grafted gelatin/polymer must comprise the polymer, preferably at least 20% by weight, and more preferably at least 25% by weight.

The following data were derived from graft-compolymers of polystyrene sulphonate and photographic gelatin produced by in-situ free-radical polymerization of styrene sulphonic acid in the presence of gelatin. This type of reaction results in covalent attachment of the growing polymer chains to the gelatin.

The physico-chemical properties of gelatin-PSS (polystyrene sulfonate) copolymers vary with the ratio PSS:gelatin and also with the reaction conditions. Typical data for copolymers containing 10–30% PSS (dry basis) are illustrated below, in comparison with the parent gelatin.

| | ND97 | ND98 | ND100 | Gelatin |
|---|---|---|---|---|
| Gelatin:PSS | 70:30 | 80:20 | 90:10 | 100 |
| Nitrogen % | 10.7 | 12.3 | 13.7 | 15.2 |
| =Gelatin % | 59.0 | 67.8 | 75.5 | 83.8 |
| Hydroxyprolin e % | 8.1 | — | 10.0 | 12.0 |
| =Gelatin % | 57.8 | — | 71.4 | 85.7 |
| Ash % | 12.3 | 8.1 | 5.7 | 0.9 |
| Moisture % | 12.1 | 14.2 | 11.2 | 11.4 |
| pH | 7.1 | 6.6 | 6.3 | 5.9 |
| Colour | 4 | 3 | 4 | 2 |
| Clarity | 6 | 5 | 6 | 2 |
| Bloom, 6 ⅔% | 114 | 207 | 258 | 258 |
| Viscosity, mps at 60° C. | 2277 | 830 | 401 | 45 |
| pI | 2.7 | 3.7 | 3.8 | 5.0 |
| Conductivity, 1% Solution pH 7.5, 25° C., IN uS | 1030 | 830 | — | 260 |

EXAMPLE 2

The three mixtures below were prepared and held at 40° C.

| | A |
|---|---|
| X-ray Photo Emulsion | 1000 g |
| Water | 1000 g |

| | B | | C |
|---|---|---|---|
| Gel:PSS (70:30) | 45 g | Gel,PSS (70:30) | 30 g |
| Water | 1455 g | Water | 1000 g |
| 0.3% Vanadium pentoxide | 375 g | 10% Surfactant (WA2) | 5.0 g |
| 10% Surfactant | 18.2 g | 3.75% Formaldehyde | 5.0 g |
| 3.75% Formaldehyde | 7.5 g | | |

Three coatings were made using a slot coater where the coated width is 8.75 inches and the web speed 25 feet per minute. The coatings were made on standard primed and subbed x-ray base and then chilled to set the gelatin and subsequently dried by air impingement. The first coating was one of two layers coated together, with mixture A, the bottom layer, coated at a flow of 130 ml/minute and mixture B, the top layer, coated at a flow of 60 ml/minute. The second coating was made by coating mixture A as a single layer and then coating mixture B on top of the dried layer at the same respective flows. The third coating was made the same as the second coating but substituting mixture C for the mixture B. The dried coatings which were of good quality were then converted into sheets. The coatings were held at 50% R.H./20° C. for four hours followed by 24-hour conditioning periods at 25% R.H./20° C., 10% R.H./20° C., and again at 25% R.H./20° C. The static decay was measured at each condition using the ets Static Decay Meter and measuring the time in seconds for decay from 5.0 kv to 0.0 kv. The results are given in TABLE 2.

TABLE 2

| | ets Static Decay Measurements | | | |
|---|---|---|---|---|
| Coating Description | 50% R.H. | 25% R.H. | 10% R.H. | 25% R.H. |
| B/A, 1 coating pass | .61 sec. | .38 sec. | .19 sec. | .25 sec. |
| B//A, 2 coating passes | .82 sec. | .43 sec. | .21 sec | .35 sec. |
| C//A, 2 coating passes | ∞ | ∞ | ∞ | ∞ |

(1) ∞ indicates the film construction is an insulator.

The above results demonstrate that a dispersion of vanadium oxide plus a graff-copolymer of polystyrene sulfonate and photographic gelatin can be incorporated and coated by techniques common to gelatin-based coatings where the requirements of setting of the chilled layers and drying by air impingement are met. The static decay data is characteristic of an electronic conductor, since no humidity dependence is noted. The amount of mixing of the two layers coated together can be considered minimal since the two coating methods, wet on wet and wet on dry, give essentially the same static decay results. The coating without vanadium oxide behaves as an insulator at all the relative humidities in Table 2.

EXAMPLE 3

The following two mixtures were prepared and coated on conventional 7 mil blue primed and subbed x-ray base.

| D | | E | |
|---|---|---|---|
| Gelatin | 6 g | Gel:PSS (70:30) | 6 g |
| Water | 194 g | Water | 194 g |
| 10% Surfactant | 0.3 g | 0.3% Vanadium pentoxide | 50 g |
| | | 10% Surfactant | 1.0 g |
| | | 3.75% Formaldehyde | 1.5 g |

The above mixtures were coated by hand using a #24 wire wound rod for the coating of mixture D and a #12 wound rod for the coating of mixture E. Two coatings were made, one of D alone as a control and another in which mixture D was coated, dried, and in turn overcoated with mixture E. The comparison of the two dried coatings on a white background made it apparent that the coating with mixture E had a slight yellow tint relative to the coating of mixture D alone. The two coatings were then processed by hand according to the sequence, X-ray Developer—Fix—Wash with one minute in each bath. The two coatings were then dried for three minutes at 55° C. and again placed against the white background. It was not possible to discern any difference in tint between the two samples. It is expected that the vanadium was converted to the colorless vanadate form in the alkaline x-ray developer.

EXAMPLE 4

The film construction described in Example 3 in which mixture E was coated over mixture D was tested for wet adhesion. The film was immersed in x-ray developer for 30 seconds, removed, placed on a flat surface, scored in a crosshatch pattern with the tip of a razor blade, and while still wet with developer, rubbed vigorously in a back-and-forth motion 16 times. Examination of the sample both before and after drying gave no indication of any adhesion failure.

EXAMPLE 5

Example 5 describes how in the presence of a graft-copolymer of polystyrene sulfonate and photographic gelatin mixed with vanadium oxide it is possible to add conventional photographic gelatin to give a homogeneous mixture that yields transparent coatings that are antistatic.

The preparation of a 3% solution of a graft-copolymer of polystyrene sulfonate and photographic gelatin was made by soaking the Gel:PSS (70:30) in chilled DI water for 30 minutes, then heating to 60° C. and stirring until solution was complete, and then cooling to 40° C. A 3% solution of photographic gelatin was prepared in a similar manner. A 0.3% vanadium oxide sol was added while stirring to the Gel:PSS solution to prepare a homogeneous mixture. The 3% gelatin was in turn added and the homogeneity of the solution was maintained. The table below illustrates the composition of mixtures prepared.

| | A | B | C |
|---|---|---|---|
| 3% Gel:PSS (70:30) | 64 | 50 | 25 |
| 0.3% Vanadium oxide | 25 | 25 | 25 |
| 3% Photo gelatin | 36 | 50 | 75 |
| 10% Surfactant | 1.2 | 1.2 | 1.2 |
| 3.75% Formaldehyde | .66 | .66 | .66 |

The above homogeneous mixtures were maintained at 40° C. and coated on primed and subbed 7 mil blue polyester x-ray base using a #12 wire wound rod and dried at room temperature for 3 minutes and then at 35° C. for 3 minutes. The resultant coatings were clear and transparent.

The coatings were conditioned for 5 days at 10% R.H./20° C., the static decay measured on the ets Static Decay Meter and then conditioned 18 hours at 50% R.H./20° C. and remeasured. The results are given in the table below.

| | ets Static Decay Measurements (5.0→0.0 Kv) | |
|---|---|---|
| Sample ID | 10% R.H. | 50% R.H. |
| A | .01 sec. | .01 sec. |
| B | .01 sec. | .04 sec. |
| C | .01 sec. | .09 sec. |

The above demonstrates the preparation of a mixture of a graff-polystyrene sulfonate and photographic gelatin with vanadium oxide to which is added a photographic gelatin solution to give a homogeneous mixture. This mixture when coated on a primed and subbed polyester substrate gives a transparent coating having excellent antistatic properties that are independent of the relative humidity.

EXAMPLE 6

Example 6 describes a mixture with an antihalation dye that gives an antistatic coating.

The following mixtures were prepared in which an antihalation dye, useful in x-ray IR laser image films, is present.

| | A | B |
|---|---|---|
| Gel:PSS (70:30) | 6.0 g | 6.0 g |
| Water | 194 | 194 |
| | Soak RT, heat to 50° C., dissolve, cool to 40° C. | |
| 0.3% Vanadium oxide | 50 | — |
| 0.6% AH Dye | 2.3 | 2.3 |
| Auxiliary Dye | .3 | .3 |
| 10% Surfactant | .66 | .66 |
| 3.75% Formaldehyde | .37 | .37 |

The mixtures A and B were coated using a #24 wire wound rod onto primed and subbed 7 mil polyester to give transparent coatings that were dried 3 minutes at room temperature and then 3 minutes at 35° C. The resultant coatings were then conditioned for 2 days at 10% R.H./20° C. and the static decay read on the ets Static Decay Meter. The sample coated from mixture A had a decay time of 0.01 second from 5.0 Kv. to 0.0 Kv. The sample coated from mixture B behaved as an insulator and exhibited no charge conduction.

EXAMPLE 7

Example 7 describes a mixture with a silver halide emulsion that yields an antistatic coating.

The following two mixtures were prepared,

| | A | | B |
|---|---|---|---|
| 3% Gel:PSS (70:30) | 25 g | Silver Iodobromide emulsion | 33 g |
| 0.3% Vanadium oxide | 25 | Water | 100 |

The two mixtures were maintained at 40° C. and B was added to A with stirring to give a homogeneous mixture of A and B. This resultant mixture was coated onto primed and subbed polyester that is routinely used in the manufacture of x-ray film. The coating was made using a #24 wire wound rod and dried 3 minutes at room temperature followed by 3 minutes at 35° C. The resultant coating was then conditioned for 2 days at 10% R.H./20° C. and the static decay read on the ets Static Decay Meter. The decay time was 0.29 seconds for decay from 5.0 Kv to 0.0 Kv.

The above results demonstrate that a silver halide photographic emulsion can be mixed with a Gel:PSS (70:30) and vanadium pentoxide mixture to give a homogeneous mixture which when coated on a polyester substrate, dried and conditioned at a low relative humidity, demonstrates very good antistatic properties.

I claim:

1. An antistatic film construction comprising a polymeric substrate having on at least one surface thereof an antistatic layer comprising the grafted product of gelatin and polymer having acid groups and particles of vanadium oxide wherein said polymer having acid groups comprises a polymer formed from ethylenically unsaturated monomers.

2. The film construction of claim 1 wherein the polymeric substrate comprises polyethyleneterephthalate.

3. The film construction of claim 2 wherein said antistatic layer is on only one side of said substrate.

4. The film construction of claim 1 wherein said antistatic layer consists essentially of the grafted gelatin and said vanadium oxide particles.

5. The film construction of claim 2 wherein said antistatic layer consists essentially of the grafted gelatin and said vanadium oxide particles.

6. The film construction of claim 2 in which the grafted product to vanadium oxide weight ratio is 2:1 to 200:1.

7. A photographic film comprising the film construction of claim 1, having a silver halide emulsion layer adhered to at least one side of said film base.

8. The photographic construction of claim 7 wherein said emulsion layer is on the same side of said film base as said antistatic layer.

9. The photographic construction of claim 7 wherein said emulsion layer is on the opposite side of said film base as said antistatic layer.

10. The photographic film of claim 9 wherein an auxiliary gelatin layer is adhered to said antistatic layer.

11. A photographic film comprising the film construction of claim 1 having a silver halide emulsion layer adhered to at least one side of said film construction.

12. The photographic film of claim 11 wherein said emulsion layer is on the same side of said film construction as said antistatic layer and the acid groups on said antistatic layer comprise sulfonic acid groups.

13. The photographic film of claim 11 wherein said emulsion layer is on the opposite side of said film construction as said antistatic layer and the acid groups on said antistatic layer comprise sulfonic acid groups.

14. The photographic film of claim 13 wherein an auxiliary gelatin layer is adhered to said antistatic layer.

15. A photographic film comprising the film base of claim 2 having a silver halide emulsion layer adhered to at least one side of said film construction.

16. The photographic film of claim 15 wherein said emulsion layer is on the same side of said film base as said antistatic layer.

17. The photographic film of claim 15 wherein said emulsion layer is on the opposite side of said film base as said antistatic layer.

18. The photographic film of claim 17 wherein an auxiliary gelatin layer is adhered to said antistatic layer.

19. The photographic film of claim 11 wherein the acid groups comprise sulfonate groups.

* * * * *